US006536250B1

(12) United States Patent
Borchert

(10) Patent No.: US 6,536,250 B1
(45) Date of Patent: Mar. 25, 2003

(54) APPARATUS AND METHOD FOR VACUUM DENT REPAIR

(75) Inventor: Donald Paul Borchert, Fridley, MN (US)

(73) Assignee: Dent Defyer, Inc., Lakeville, MN (US)

( * ) Notice: Subject to any disclaimer, the term of this patent is extended or adjusted under 35 U.S.C. 154(b) by 0 days.

(21) Appl. No.: 09/707,562

(22) Filed: Nov. 6, 2000

Related U.S. Application Data

(60) Provisional application No. 60/163,694, filed on Nov. 5, 1999.

(51) Int. Cl.[7] ..... B21D 1/12
(52) U.S. Cl. ..... 72/37; 72/60; 72/705
(58) Field of Search ..... 72/37, 60, 211, 72/705, 710

(56) References Cited

U.S. PATENT DOCUMENTS

| | | | | |
|---|---|---|---|---|
| 3,584,836 A | | 6/1971 | Brubaker, Sr. | 254/124 |
| 3,719,347 A | | 3/1973 | Wolgast et al. | 254/124 |
| 3,728,891 A | | 4/1973 | Hall, Jr. | 72/465 |
| 3,779,057 A | | 12/1973 | Sonnenberg | 72/56 |
| 4,008,591 A | * | 2/1977 | Vos et al. | 72/38 |
| 4,026,139 A | | 5/1977 | Glaser et al. | 72/389 |
| 4,050,271 A | * | 9/1977 | Jones | 72/37 |
| 4,057,994 A | | 11/1977 | Wolgast et al. | 72/441 |
| 4,089,201 A | | 5/1978 | Raptis | 72/390 |
| 4,116,035 A | | 9/1978 | Malarsky | 72/389 |
| 4,252,008 A | | 2/1981 | Dibbens | 72/56 |
| 4,495,791 A | | 1/1985 | Kemnitz et al. | 72/453.02 |
| 4,753,104 A | | 6/1988 | Strozier | 72/457 |
| 4,754,637 A | | 7/1988 | O'Dell | 72/430 |
| 5,203,196 A | | 4/1993 | Jenkins | 72/391.2 |
| 5,408,861 A | | 4/1995 | McCain et al. | 72/457 |
| 5,479,804 A | | 1/1996 | Cook | 72/35 |
| 5,575,165 A | | 11/1996 | Roseberry | 72/56 |
| 5,727,418 A | | 3/1998 | Strozier | 72/457 |
| 6,014,885 A | | 1/2000 | Griffaton | 72/453.16 |

FOREIGN PATENT DOCUMENTS

| | | | | |
|---|---|---|---|---|
| DE | 27 27 355 | * | 1/1979 | 72/705 |

OTHER PUBLICATIONS

Oct. 27, 2000, Web Pages: http://www.paintbull.com/HTML/automotive_paintless_dent_repair.html.
Oct. 27, 2000, Web Pages: http://www.dentbusters.com/html/process.html.
Oct. 27, 2000, Web Pages: http://www.paintlessdentrepair-.com/content.asp?pid=65.

* cited by examiner

*Primary Examiner*—Lowell A. Larson
(74) *Attorney, Agent, or Firm*—Daniel A. Dettlaff

(57) ABSTRACT

A dent removal system is provided having a portable vacuum chamber head and a shaper vacuum roller coupled to a vacuum source. The vacuum chamber head has a center see-through window for aligning the head over a dented work surface, a template of desired surface shape and a matrix of closely-spaced standoff pins to communicate the template shape to the work surface while allowing passage of vacuum to the dent. A method is provided for removing dents in sheet metal surfaces using the dent removal system. The vacuum chamber head is positioned over the dented work surface and sealed. The work surface is excited with vibrational energy. Within the vacuum chamber head, force is applied to the template face to hold the template in fixed relation to the work surface. The template shape is transmitted to the work surface via the matrix of standoff pins. Vacuum is applied to the chamber head, through the standoff pin matrix to the work surface sucking the dent out of the work surface and forcing the work surface into contact with the standoff pins. The vacuum chamber head is vented to atmosphere, releasing the vacuum, and removed. The shaper vacuum roller is rolled over the work surface to remove minute imperfections.

18 Claims, 11 Drawing Sheets

APPARATUS AND METHOD FOR VACUUM DENT REPAIR

CROSS-REFERENCE TO RELATED APPLICATIONS

This Non-Provisional Utility Application claims the benefit of the filing date of U.S. Provisional Application Serial No. 60/163,694 filed Nov. 5, 1999, entitled "DENT DEFYER INC."

THE FIELD OF THE INVENTION

The present invention generally relates to sheet metal working, and more particularly to removal of dents from sheet metal surfaces of automobiles, airplanes, recreational vehicles, trailers, boats, house siding and the like.

BACKGROUND OF THE INVENTION

Sheet metal is widely used as the surface skin on vehicles, enclosures and shelters. Aluminum is conventionally used on airplanes while automobiles normally have sheet steel bodies. Both aluminum and steel are used to form house siding. A protective coating is often applied to the exterior surface of these sheet metal bodies. Sheet metal thickness is relatively thin in these applications to ease forming operations, and to minimize cost and weight. However, relatively thin sheet metal is susceptible to concave denting, frequently from projectiles such as hail, rocks or other small objects impacting the sheet metal surface.

Removing dents can be cost effective versus removing and replacing the damaged sheet metal, particularly if the repair can be accomplished without the necessity for subsequent surface sanding, grinding or refinishing operations. Various dent-removing tools and methods are conventionally known.

One known method is to fill-in the concave indentation with metal or plastic which is subsequently smoothed and refinished to match the adjacent surface. Repair techniques involving fillers are time-consuming, labor-intensive, messy and expensive. If the dent is accessible from behind, the sheet metal forming the dent can be hammered or pushed back out to its original condition. Frequently, the rear of dented panels are often enclosed and access is difficult. So-called "paintless dent repair" methods often involve drilling small access holes into enclosing panels or structures and using specialized hand tools to remotely access the dented surface. This practice requires highly-trained labor, is tedious, expensive and leaves numerous access holes in the enclosing panel or structure.

Consequently, a number of tools have been developed to remove concave dents from the exterior of the dent. Perhaps best known is a slide hammer or "slap" hammer with a screw-end. The screw-end is first embedded in a hole drilled into the dent. A pulling force is then applied by rapidly sliding a weight or hammer along a rod away from the screw and against a stop on the end of the rod opposite the screw. Such devices damage the surface being repaired by leaving a screw hole in it which must be subsequently filled and refinished.

Non-destructive means to grasp the dented material have been employed as well, most notably, a conventional suction cup. Vacuum is used to attach a suction cup to the indented material. Subsequently, mechanical means are used to pull the suction cup, and the attached indented material, outward. Levers, chains, slide hammers and hydraulics have been employed to apply the outward force to the suction cup. The suction device often hides the indentation from view making it difficult to bring the sheet metal into precise alignment with the adjacent surfaces. If the indentation has stretched the sheet metal too much, the suction cup force pulls the dent beyond the intended position leaving a convex dimple in the sheet metal surface.

Various conventional electromagnetic means have been used to remove dents from magnetic and non-magnetic metal surfaces. An electromagnet is positioned over the dent and energized with electricity creating a magnetic field. Magnetic sheet metal surfaces can be directly drawn flat against the face of a matrix formed in the shape of the desired surface. A magnetic metal element is used behind a non-magnetic metal surface. The electromagnet draws the magnetic backing material through the non-magnetic surface pinching the non-magnetic surface into the desired shape. Access behind the non-magnetic surface is obviously required. Electromagnetic tools are cumbersome and expensive to construct and operate.

For reasons stated above and for other reasons presented in greater detail in the Description of the Preferred Embodiments section of the present specification, a dent removal system and method is desired which removes dents quickly, simply, accurately and inexpensively.

SUMMARY OF THE INVENTION

The present invention is generally directed to a system and method for forming sheet metal. The invention is particularly suited for forming sheet metal, such as to remove dents and the like, quickly, simply, accurately and inexpensively. While the present invention is not necessarily limited to a sheet metal forming application, such as dent removal, the invention will be better appreciated using a discussion of exemplary embodiments in such a context.

In an example embodiment, the present invention provides a system for forming sheet metal including a chamber head for receiving vacuum into its interior and a vacuum inlet valve, arranged between the vacuum chamber head and a vacuum source, for controlling the receipt of vacuum. The vacuum chamber head has a sealing arrangement for providing a substantially airtight seal between the vacuum chamber head and the sheet metal, and an outlet valve for releasing the vacuum from the interior of the vacuum chamber head. The sealing arrangement includes a plurality of gaskets located one within the perimeter of another. The gaskets decrease in depth profile and compressibility from outside gasket to inside gasket. Vacuum is applied to spaces between gasket seals. The sheet metal is formed to the shape of a template internal to the vacuum chamber head. A matrix of standoff pins indicate the sheet metal topography and communicate the form of the template to the sheet metal surface while allowing vacuum to pass therethrough. The standoff pin matrix is visible through a clear window in the vacuum chamber head. The window has crosshairs to indicate the center of the vacuum chamber head and standoff pin matrix. Springs dampen the speed of sheet metal movement caused by vacuum forces. The system further includes a vibrational energy source magnetically coupled to the sheet metal through a thin protective layer in close proximity to the vacuum chamber head, and a shaper vacuum roller to attract and compress the sheet metal surface into a uniform profile.

In another example embodiment, a shaper vacuum roller for forming sheet metal is provided including an enclosed, hollow cylinder adapted on at least one end to receive vacuum. One or more vents are provided through the wall of the cylinder. Vacuum is received by the cylinder and drawn through the vent(s) such that when the shaper vacuum roller is placed in contact with a sheet metal surface, the vacuum through the vents attracts the sheet metal towards the shaper vacuum roller, to which the shaper vacuum roller cylinder wall provides and opposite resisting force acting to compress the sheet metal surface. A housing substantially impedes vacuum from being drawn through cylinder vents not in contact with the sheet metal surface. The cylinder can be adapted to roll within the housing. The vent(s) are shaped in a tapered fashion such that when the cylinder rolls, a narrow portion of the vent lifts up from the surface of the sheet metal first, thus aiding in the release of vacuum pressure at each vent to ease rolling action. In one example embodiment, the vents are substantially diamond-shaped and arranged such that the tips of the diamonds separate (e.g., lift) from the sheet metal first as the cylinder rolls. The housing can be handle-shaped and include a switch for controlling the receipt of vacuum to the shaper vacuum roller.

In yet another aspect of the invention, a method of forming sheet metal using vacuum is provided including positioning a vacuum chamber head having an internal template over the sheet metal surface, sealing the vacuum chamber head to the sheet metal surface, supplying vacuum to the vacuum chamber head to pull the sheet metal surface into the shape of the template, venting and removing the vacuum chamber head. Vibrational energy is provided to the sheet metal prior to supplying vacuum. Springs can be used to dampen the movement speed of the sheet metal surface due to vacuum forces. The sheet metal surface is rolled with a shaper vacuum roller to remove minor surface imperfections.

The above summary of the present invention is not intended to describe each illustrated embodiment or every implementation of the present invention. While dent repair is illustrated, other sheet metal forming operations can benefit from the teachings described herein. Various modifications, equivalent processes, as well as numerous structures to which the present invention may be applicable will be readily apparent to those of skill in the art to which the present invention is directed upon review of the present specification. The claims are intended to cover such modifications and devices.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
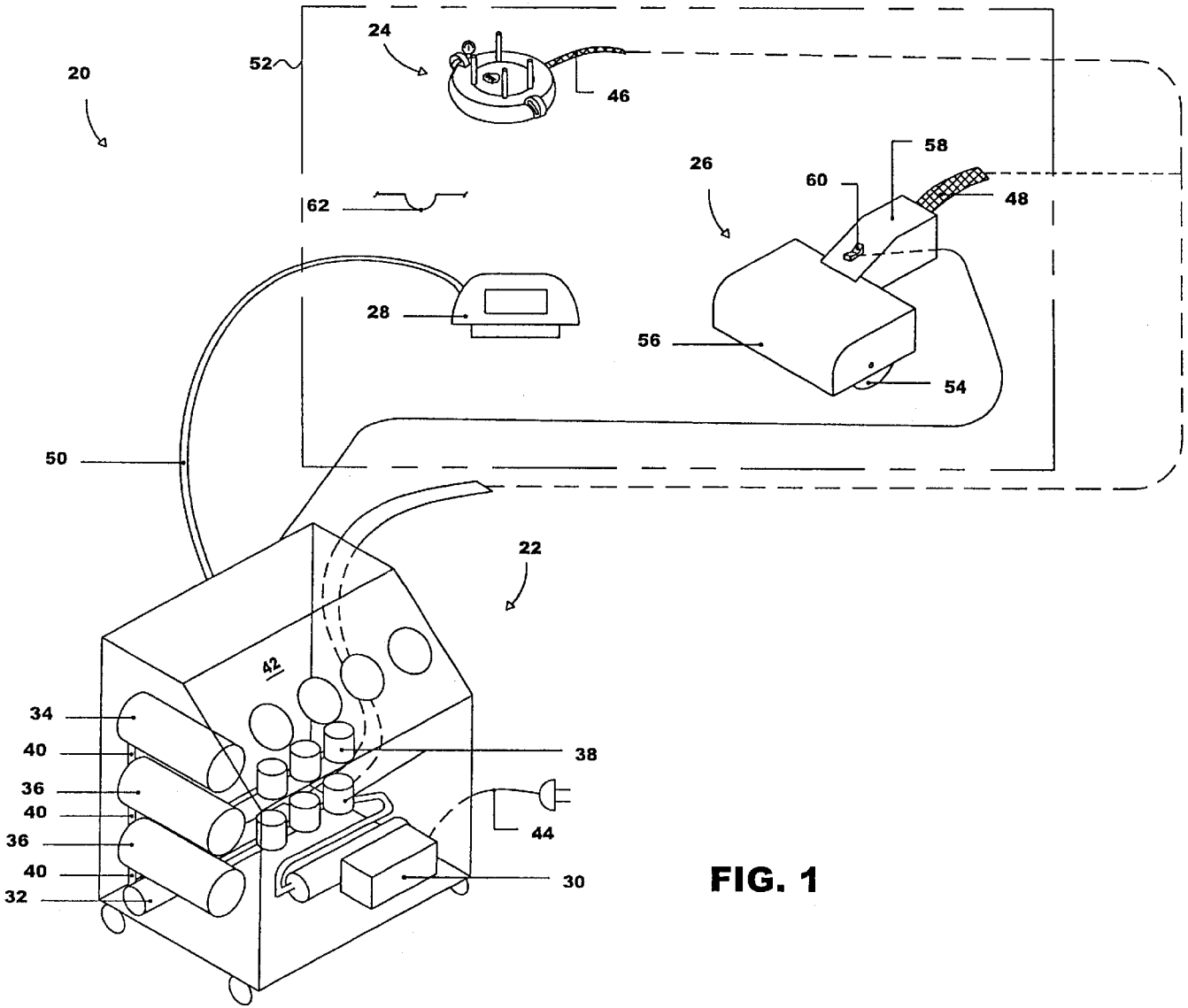
FIG. 1 is a perspective view of a dent removal system according to the present invention including a vacuum source, vacuum chamber head, shaper vacuum roller, and vibrational energy source.

One embodiment of a dent removal system according to the present invention is illustrated generally at 20 in FIG. 1. Dent removal system 20 includes a vacuum source 22, a vacuum chamber head 24, a shaper vacuum roller 26 and a vibrational energy source 28. Vacuum source 22 includes a vacuum pump 30, a low pressure storage tank 32, a high-pressure storage tank 34, and intermediate-pressure storage tanks 36. Storage tanks 32–36 are interconnected through regulators 38 and electronically-controlled valves 40. A control board 42 provides means to monitor and control the status of vacuum source 22 components. Vacuum pump 30 generates sufficiently low vacuum by pumping through a number of successive pressure stages. Vacuum pump 30 may be driven by electric or combustion engine. If electric, vacuum pump 30 is electrically coupled to an external power source via cord 44. Alternatively, an external vacuum source may be used.

Vacuum chamber head 24 is fluidly coupled to vacuum source 22 by a first hose 46. Shaper vacuum roller 26 is fluidly coupled to vacuum source 22 by a second hose 48. First hose 46 and second hose 48 are high-pressure air hoses. First hose 46 and second hose 48 may each have high-pressure couplers (not shown) along their length to facilitate easy and fast hose connections. Either first hose 46 or second hose 48 or both may be coupled to vacuum source 22 at one time using appropriate couplers well known in the art.

Vibrational energy source 28 is electrically coupled to an external power source via cord 50. Vibrational energy source 28 motivates a mass to oscillate at high frequency creating vibrational energy. Vibrational energy source 28 is placed on a sheet metal surface 52 to be repaired in close proximity to vacuum chamber head 24 so as to vibrationally excite the dented portion of sheet metal surface 52 during repair.

Shaper vacuum roller 26 includes a hollow roller 54, partially enclosed by a body 56. A handle 58 is coupled to body 56. An electrical switch 60 is mounted on handle 58 of shaper vacuum roller 26. Switch 60 is electrically coupled to vacuum source 22 control board 42 to turn on and off the supply of vacuum to shaper vacuum roller 26.

Figure 2:
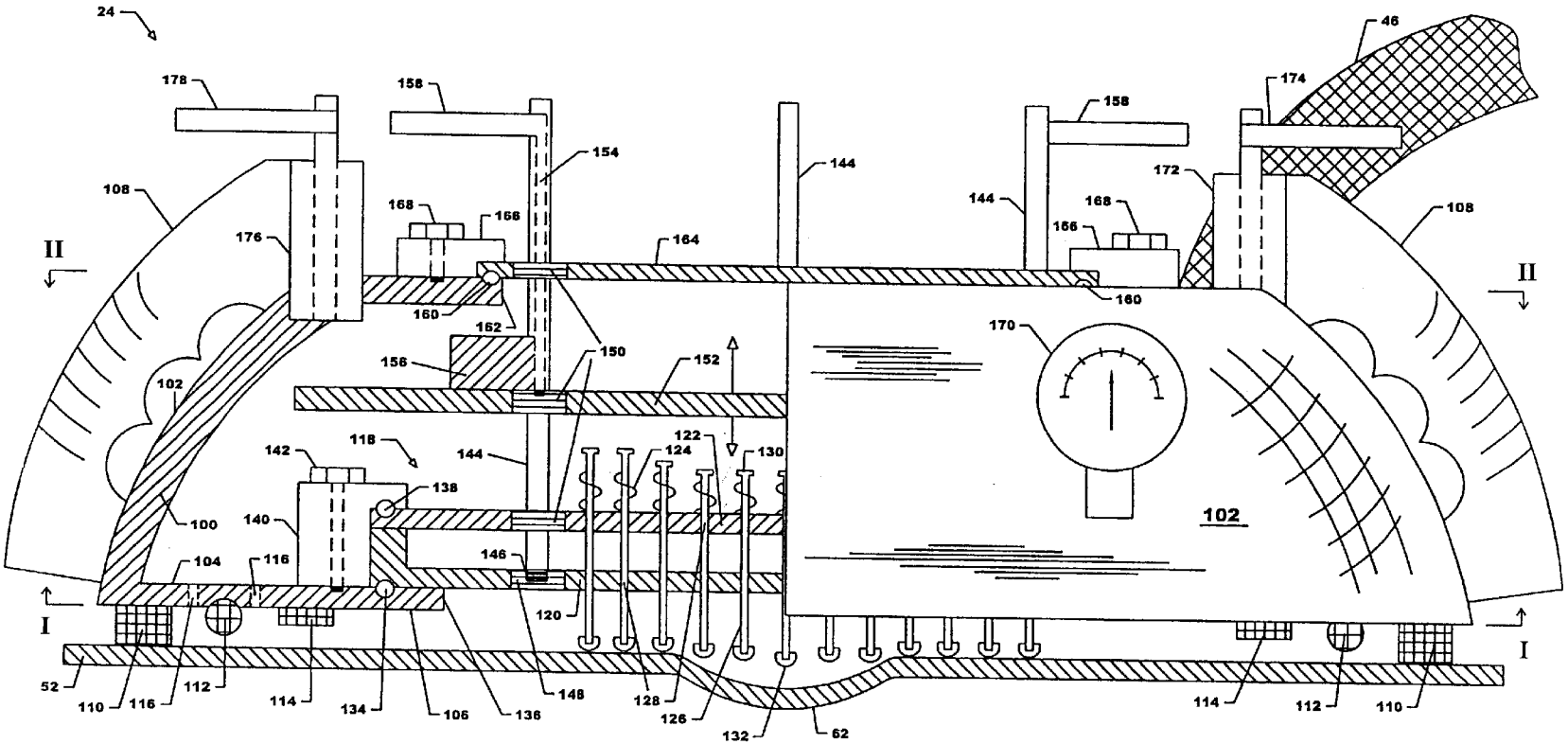
FIG. 2 is a side view (partly in section) of one embodiment of a vacuum chamber head of the present invention resting on a dented sheet metal surface prior to application of vacuum.

FIG. 2 shows a side view (partly in section) of one embodiment of vacuum chamber head 24 of the present invention. Vacuum chamber head 24 is shown resting on sheet metal surface 52 prior to application of vacuum.. Sheet metal surface 52 has an indentation 62. Vacuum chamber head 24 is constructed around a circular casting 100. Casting 100 can be formed to other shapes as well, such as square or rectangular or oval, etc. Casting 100 includes a wall having an exterior surface 102 and a base having an interior surface 104 and an exterior surface 106. Handles 108 are affixed to exterior surface 102 on opposites sides of casting 100.

Figure 6:
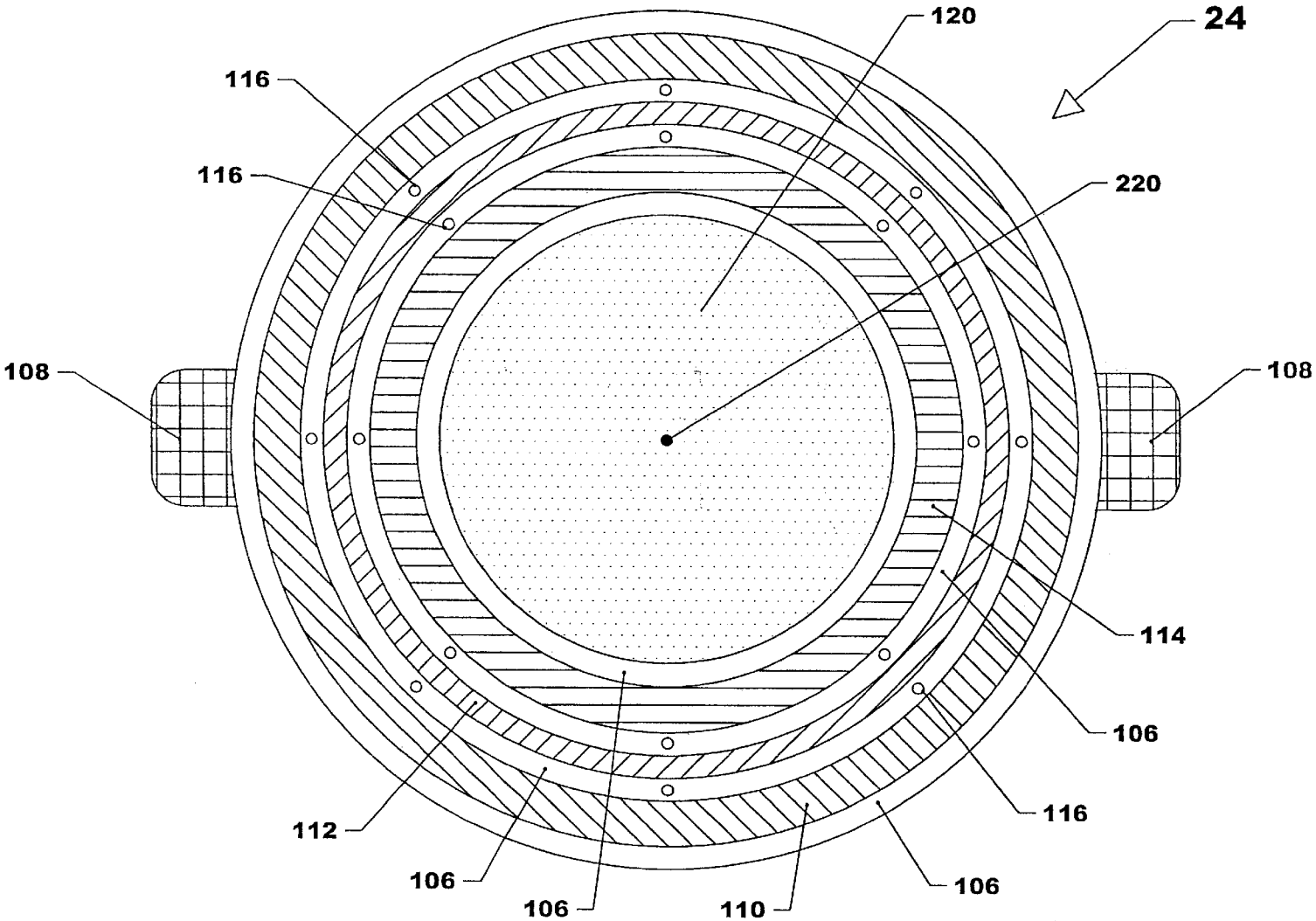
FIG. 6 is a bottom plan view, at cut A—A of FIG. 2, of one embodiment of a vacuum chamber head.

An outer gasket 110 is affixed around the perimeter of casting base exterior surface 106. A middle gasket 112 is affixed to casting base exterior surface 106 adjacent to, but interior to the perimeter formed by outer gasket 110. An interior gasket 114 is affixed to casting base exterior surface 106 adjacent to, but interior to the perimeter formed by middle gasket 112. FIG. 6 also illustrates the relative locations of casting base exterior surface 106 gaskets.

Outer gasket 110 has the greatest depth of the three casting base exterior surface 106 gaskets as can be seen in FIG. 2. Outer gasket is also formed of the most compressible material of the three gaskets, such as neoprene rubber. Interior gasket 114 has the lowest profile and is formed from the least compressible material of the three casting base exterior surface 106 gaskets, such as hard rubber. Middle gasket 112 has a depth profile intermediate between outer gasket 110 and interior gasket 114. The compressibility of the material from which middle gasket 112 is formed is also intermediate between that of outer gasket 110 material and interior gasket 114 material. In one embodiment, middle gasket 112 is a rubber O-ring. Those skilled in the art will recognize that the O-ring shape of middle gasket 112 aids in its compressibility over rectangular-shaped gasket shapes.

As vacuum chamber head 22 is placed on sheet metal surface 52, outer gasket 110 contacts sheet metal surface 52 first and forms a seal. When casting base exterior surface 106 of vacuum chamber head 22 is forced closer to sheet metal surface 52 (as is the case when vacuum is drawn from within the vacuum chamber head), middle gasket 112 contacts sheet metal surface 52 next, and lastly, interior gasket 114 contacts sheet metal surface 52. A good seal is formed between casting base exterior surface 106 and sheet metal surface 52 by outer gasket 110. A better seal is formed by the less-compressible middle gasket 112 when it makes contact, and the best seal is achieved by interior gasket 114. In this manner, higher vacuum pressures can be sealed since increasing vacuum pressures tend to draw casting base exterior surface 106 closer to sheet metal surface 52. Vent holes 116 are provided between outer gasket 110 and middle gasket 112, and between middle gasket 112 and interior gasket 114 to draw vacuum from between gaskets after they are in contact (e.g., a seal is formed) with sheet metal surface 52.

A standoff pin matrix assembly 118 includes a lower fixed plate 120, an upper fixed plate 122, lower pin springs 124 and standoff pins 126. Lower fixed plate 120 and upper fixed plate 122 are formed of clear polycarbonate or equivalent material for strength and so that the dent shape can be viewed from above. Lower fixed plate 120 and upper fixed plate 122 are circular shaped (since casting 100 is ring-shaped). An identical matrix (e.g., at each comer of a grid pattern) of holes 128 is drilled through both lower fixed plate 120 and upper fixed plate 122. Each hole 128 is slightly larger in diameter than the diameter of standoff pins 126 so that standoff pins 126 can travel freely up and down within holes 128.

The center area of lower fixed plate 120 is machined away so that the thickness around the perimeter is greater than the center thickness. Upper fixed plate 122 is placed atop lower fixed plate 120 such that each of the matrix holes is aligned. Standoff pins have a head 130. A lower pin spring 124 is slipped over each standoff pin 126 and standoff pin 126 is placed through upper fixed plate 122 hole 128 and lower fixed plate 120 hole 128. In one exemplary embodiment, standoff pins are formed of metal for strength and ease of sliding movement through fixed plate holes 128. Other materials are contemplated. To protect sheet metal surface 52 finish, each standoff pin is tipped with a protective coating 132, such as plastic or rubber. This is easily accomplished by dipping each standoff pin 126, or the matrix of standoff pins 126 into a liquid solution of protective material.

A lower fixed plate gasket 134 (O-ring) is located near the inner edge 136 of casting base interior surface 104. Standoff pin matrix assembly 118 is placed in the interior of casting 100 such that circularly-shaped lower fixed plate 120 rests atop lower fixed plate gasket 134. Casting base interior surface 104 supports lower fixed plate gasket 134, lower fixed plate 120 and the balance of standoff pin matrix assembly 118 around the perimeter of lower fixed plate 120. Another O-ring, upper fixed plate gasket 138 is located near the perimeter of the circularly-shaped upper fixed plate 122. An inverted L-shaped clamping ring 140 is located atop upper fixed plate gasket 138 and around the perimeter of upper fixed plate 122. Fasteners 142 (screws or bolts) through clamping ring 140 and into casting base interior surface 104 provide clamping force to hold standoff pin matrix assembly 118 securely in place to casting 100.

Guide pins 144 include one threaded end 146. A corresponding threaded bushing 148 is secured into lower fixed plate 120. A sleeve bushing 150 is secured into upper fixed plate 122 and moveable plate 152. Moveable plate 152 is circularly shaped and formed from clear polycarbonate. In one embodiment, threaded bushing 148 and sleeve bushings 150 are each formed of brass. Each guide pin 144 is passed through sleeve bushings 150 in moveable plate 152 and upper fixed plate and securely fastened into threaded bushing 148.

In one exemplary embodiment, guide pins 144 located near handles 108 are hollow and have a slit running along the top half of the length of guide pin 144. A force-transmitting rod 154 having a lower extension 156 and an upper lever 158 is inserted into two hollow guide pins 144. Downward force applied to upper lever 158 is transmitted via rod 154 and lower extension 156 to moveable plate 152.

A cover plate gasket 160 (O-ring) is located near the inner edge 162 of casting base exterior surface 106. Cover plate 164 is circularly shaped and formed from clear polycarbonate. Sleeve bushings 150 secured into cover plate allow guide pins 144 to extend through cover plate 164; however, cover plate sleeve bushings 150 are more snug around guide pins 144 than sleeve bushings 150 in moveable plate and upper fixed plate 122 to maintain vacuum pressure within vacuum chamber head 24. Cover plate 164 is located atop cover plate gasket 160 and supported by casing wall exterior surface 102. Another inverted L-shaped cover clamping ring 166 is located atop cover plate 164 and around the perimeter of cover plate 164. Fasteners 168 (screws or bolts) through cover clamping ring 166 and into casting 100 exterior surface 102 provide clamping force to hold cover plate 164 securely in place to casting 100.

A vacuum pressure gauge 170 is coupled to casting 100 exterior surface 102 to indicate vacuum chamber head 24 pressure. Hose 46 from vacuum source 22 is fluidly coupled to casting 100 through an inlet vacuum valve 172. An inlet lever 174 operates inlet vacuum valve 172 to admit vacuum to the interior of vacuum chamber head 24. Outlet valve 176 ports the interior of vacuum chamber head 24 to atmosphere so that interior vacuum pressure may be released. Outlet valve 176 is operated by outlet lever 178.

FIG. 2 illustrates vacuum chamber head 24 condition after positioning over dent 62, but before vacuum is drawn. Heads 130 of standoff pins 126 resting on sheet metal raise above lower pin springs 124. Heads 130 of standoff pins 126 over dent 62 fall until they ride on lower pin springs 124. The contour of dent 62 is transmitted through standoff pins 126 to heads 130 and is visible through clear cover plates (164 moveable cover 152) to aid in locating vacuum chamber head 24 over dent 62.

Figure 3:
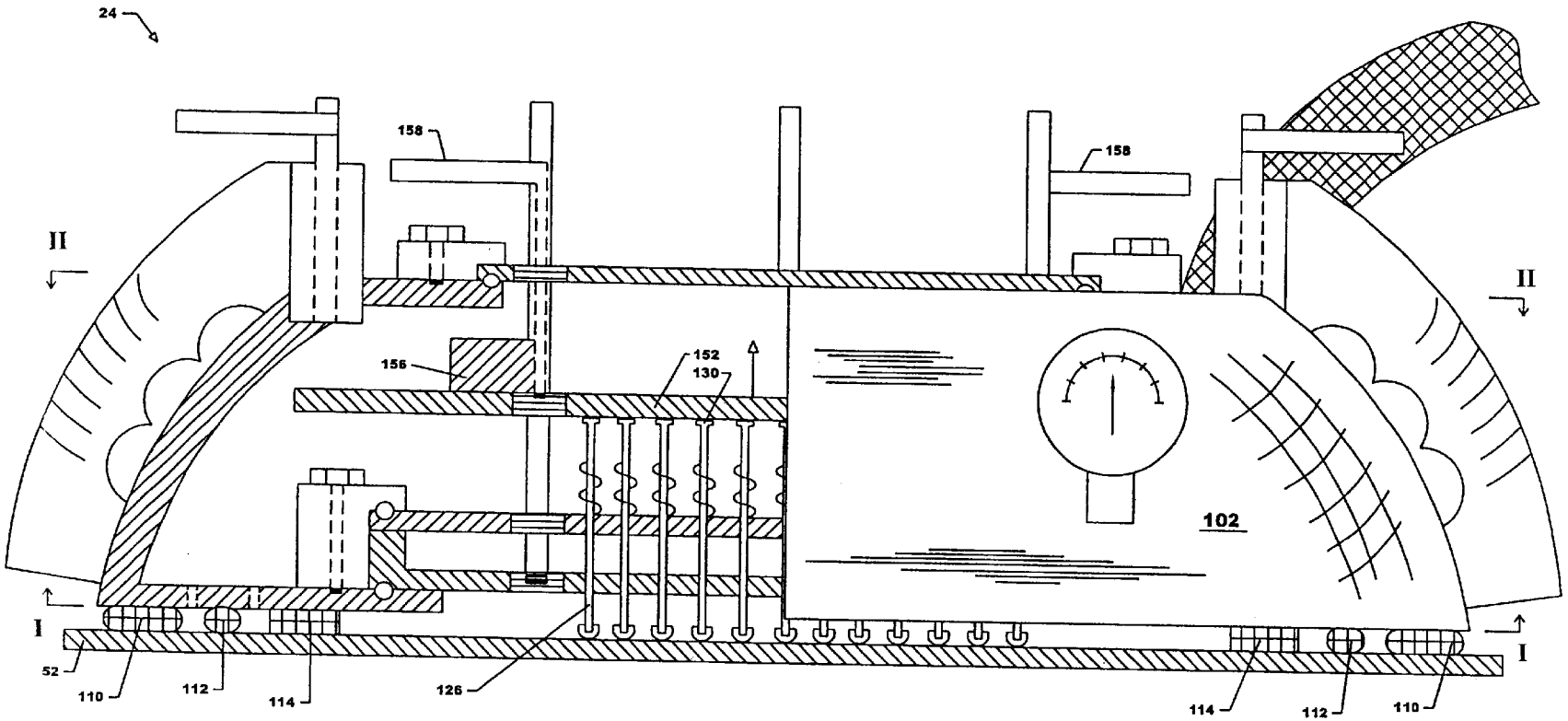
FIG. 3 is a side view (partly in section) of one embodiment of a vacuum chamber head under vacuum.
Figure 4:
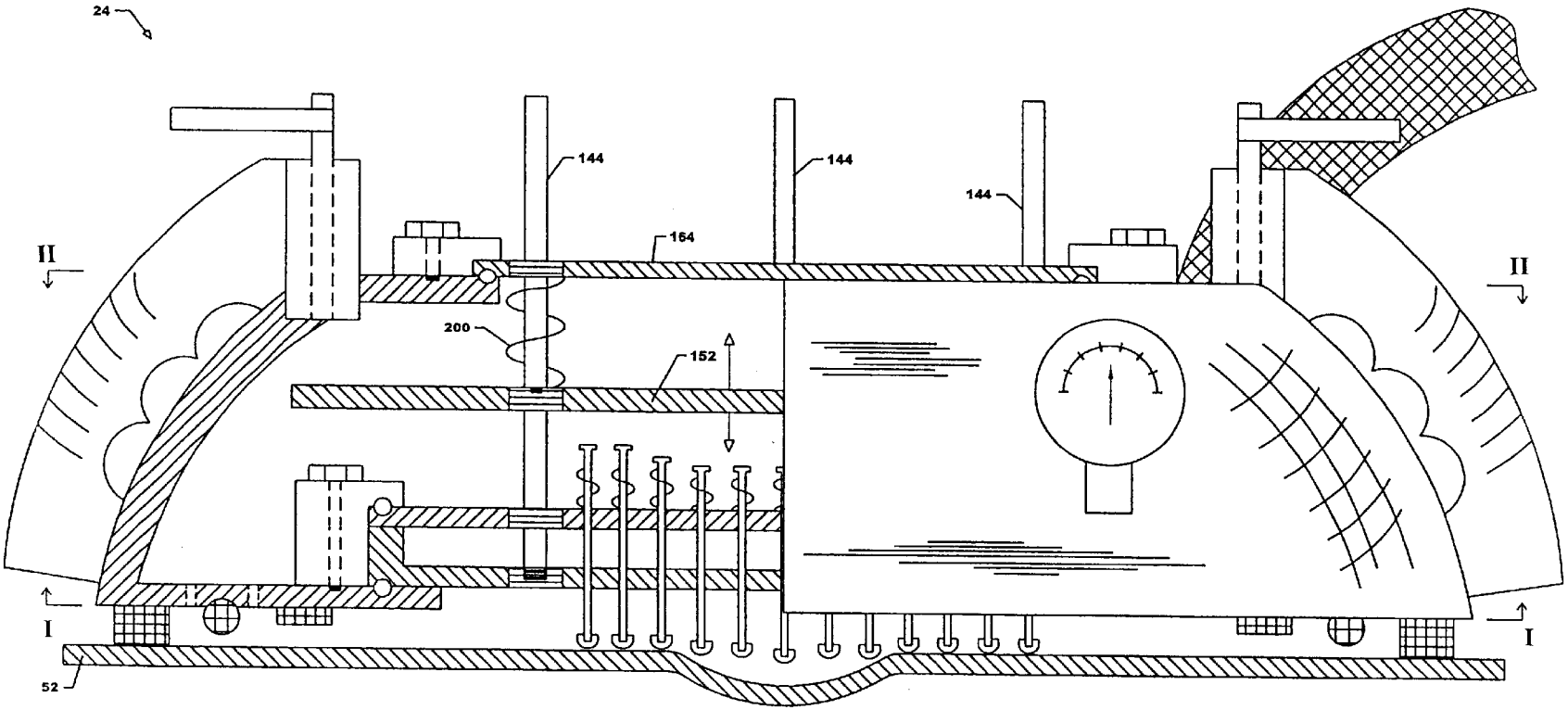
FIG. 4 is a side view (partly in section) of one embodiment of a vacuum chamber head having guide pin springs.

FIG. 3 illustrates vacuum chamber head 24 configuration while vacuum is drawn. Vacuum reaches sheet metal surface 62 through the slightly oversized standoff pin holes 128 in fixed plates (lower 120 and upper 122 respectively). Gaskets 110, 112 and 114 are compressed. Dent 62 is gone. Heads 130 of standoff pins 126 all contact moveable plate 152. Sheet metal surface 52 is drawn into the shape of moveable plate 152 as transmitted via standoff pins 126. If moveable plate 152 were contoured in some fashion, sheet metal plate 52 would be drawn up by the vacuum pressure until it formed the contoured shape as communicated by standoff pins 126.

Force is applied to upper lever 158, and in turn to moveable plate 152 via lower extension 156 to keep moveable plate 152 stationary during vacuum operations. In an alternative embodiment, upper lever 158, lower extension 156 and force-transmitting rod 154 are removed. All guide pins 144 are solid (e.g., not hollow). Guide pin springs 200 around guide pins 144, between cover plate and moveable plate 152 transmit downward force to moveable plate 152 whenever casting 100 (and thus fixed cover plate 164) moves toward sheet metal surface 52, such as by external (i.e., human) force application or due to vacuum pressure drawing vacuum chamber head 24 towards sheet metal surface 52.

Figure 5:
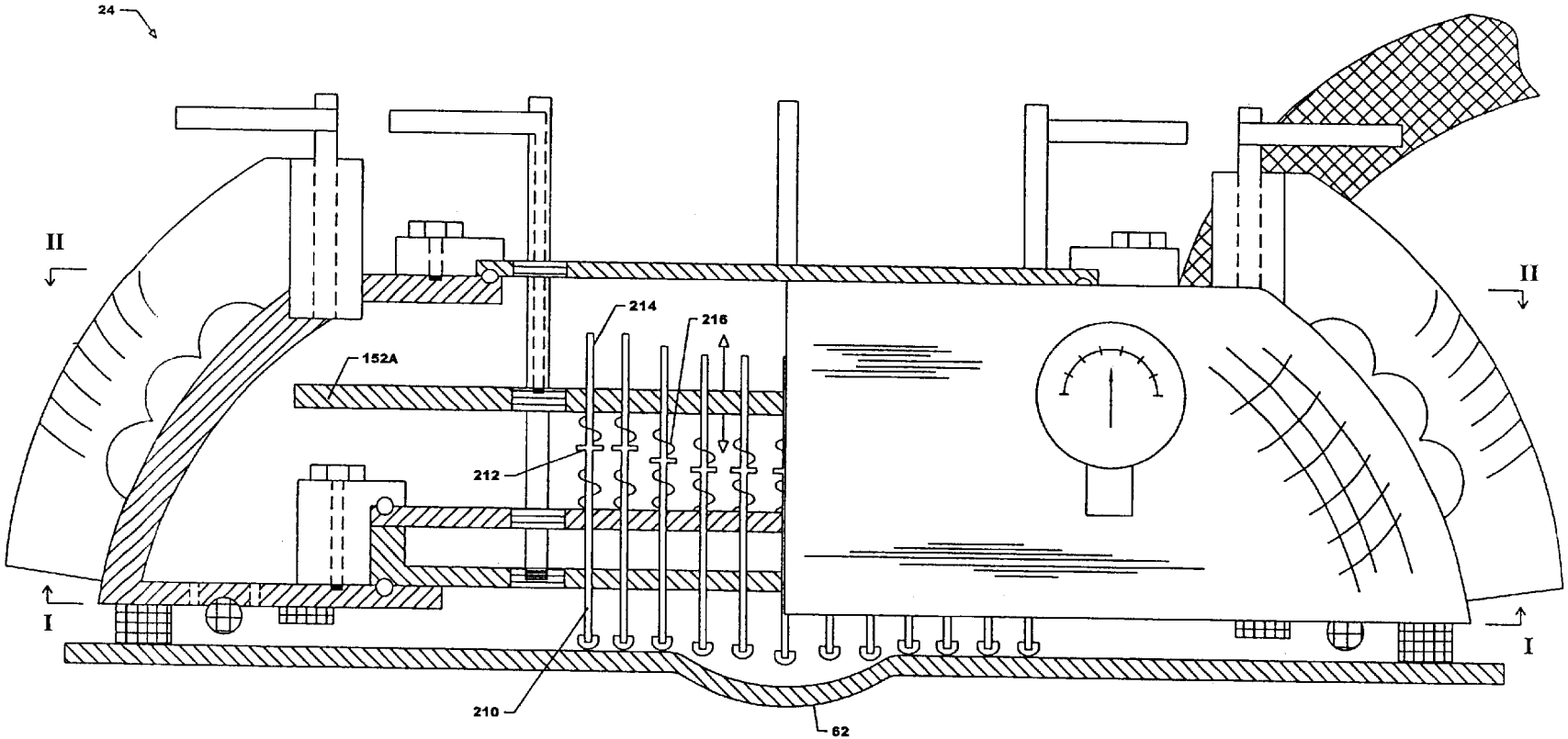
FIG. 5 is a side view (partly in section) of one embodiment of a vacuum chamber head having upper standoff pin springs.

FIG. 5 illustrates another embodiment of the present invention. Rather than head 130 located on one end of each standoff pin 126 (as in FIG. 2), standoff pins 210 have a flange 212 (located the same distance from the tip of each standoff pin as head 130). A barrel 214 of each pin extends beyond flange 212. An upper standoff pin spring 216 is located around standoff pin 210, above flange 212, but below moveable plate 152A. Moveable plate 152A has a matrix of holes drilled through it to accommodate extended barrels 214 of standoff pins 210. Upper standoff pin springs 216 absorb some of the shock from standoff pin flanges 212 as they contact moveable plate 152A as dent 62 is popped out quickly under vacuum.

FIG. 6 illustrates a bottom plan view of one embodiment of vacuum chamber head 24. Location of gaskets 110, 112 and 114 is readily visible. The grid pattern of the standoff pin assembly matrix is visible. Center standoff pin 220 may be a different color to aid in locating vacuum chamber head over the center of dent 62. In one embodiment of the present invention, approximately 1700 standoff pins 126 comprise the standoff pin matrix assembly. Closer spacing between standoff pins 126, result in finer contour communication from moveable plate 152 to sheet metal surface 52.

Figure 7:
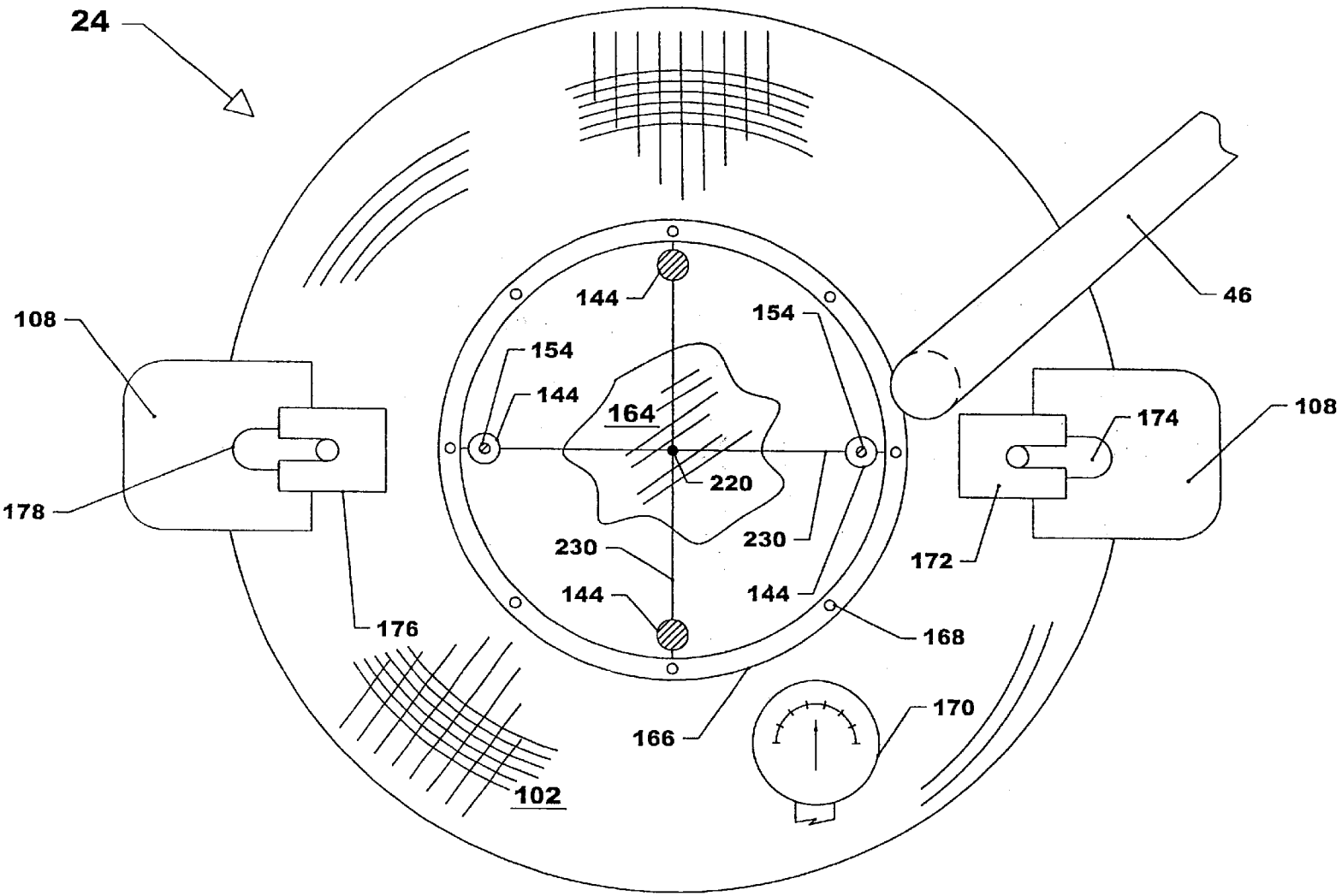
FIG. 7 is a top plan view, at cut B—B of FIG. 2, of one embodiment of a vacuum chamber head.

FIG. 7 illustrates a top plan view, at cut B—B of FIG. 2, of one embodiment of a vacuum chamber head. Cover plate 164 is etched with aiming cross-hair lines 230 visible when looking down through vacuum chamber head 24. Center pin 220 is located directly beneath the intersection of cross-hair lines 230.

Figure 8:
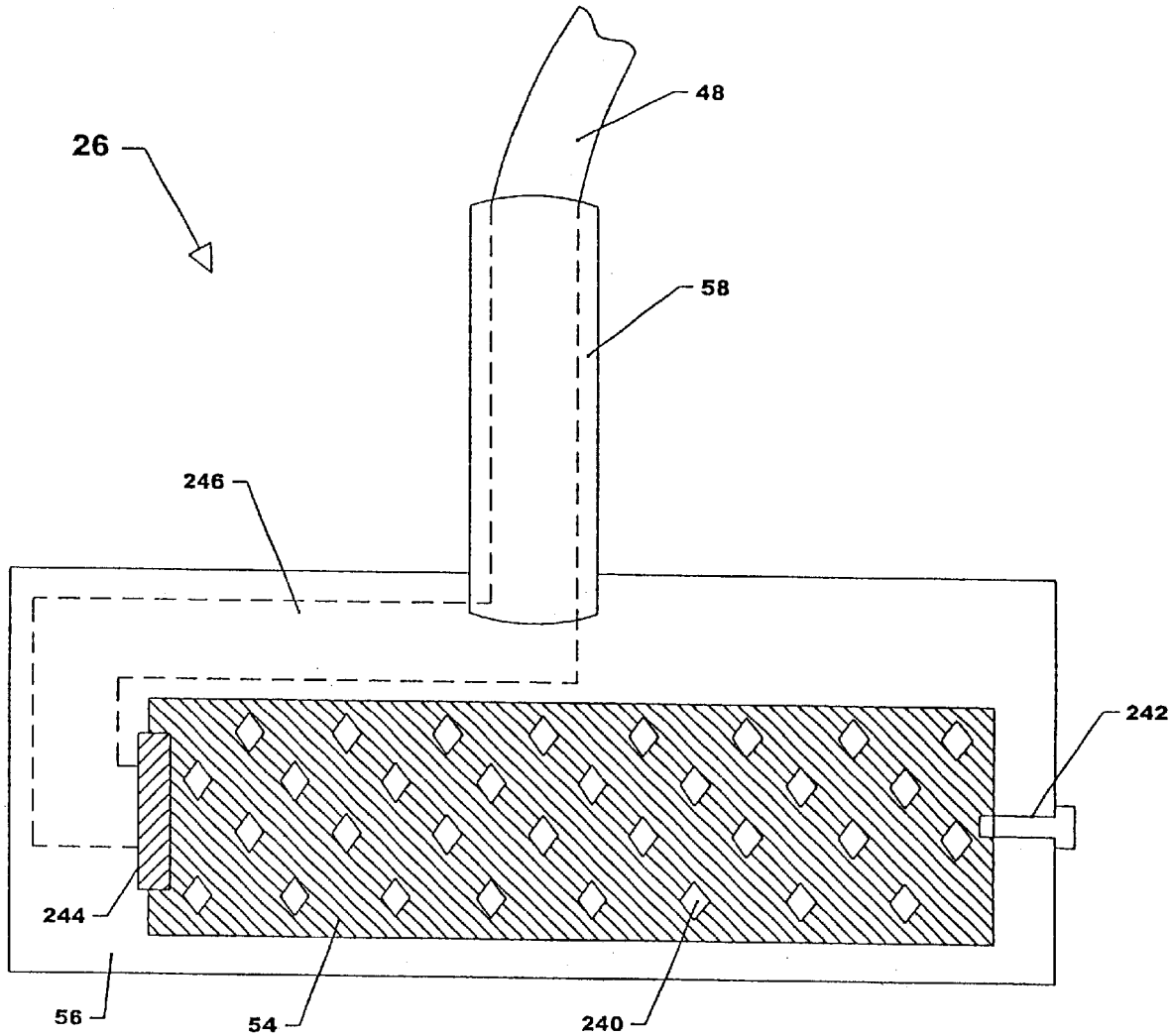
FIG. 8 is a bottom plan view of one embodiment of a shaper vacuum roller.
Figure 9:
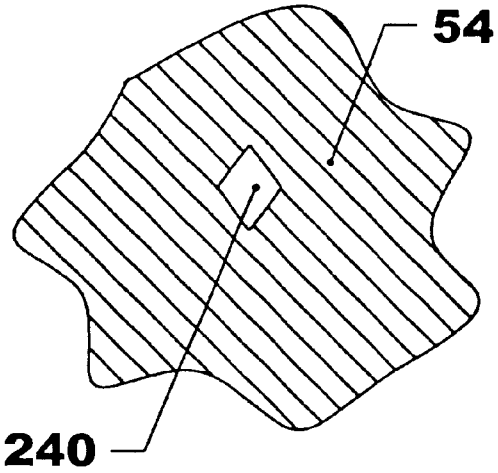
FIG. 9 is an alternative shape embodiment of a shaper vacuum roller vent opening.
Figure 10:
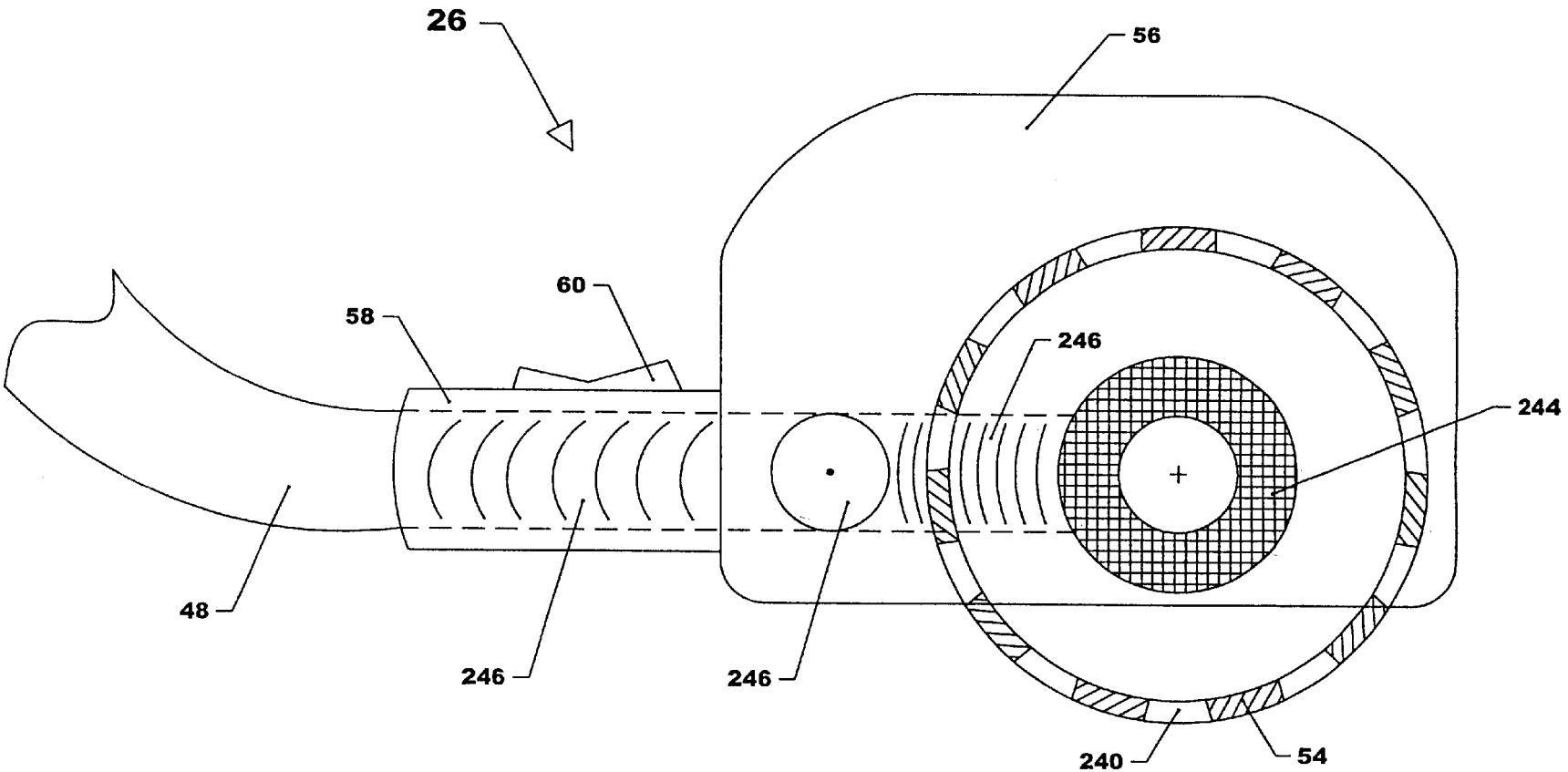
FIG. 10 is a side plan view of one embodiment of a shaper vacuum roller.

FIG. 8 illustrates a bottom plan view of one embodiment of shaper vacuum roller 26. Roller 54 includes diamond-shaped vents 240 arranged across and around roller 54. Roller 54 has a point bearing 242 at one end, which is in turn fixed to body 56. A seal bearing 244 is located at the opposite end of roller 54. Internal vacuum ducting fluidly couples hose 48 through handle 58 and body 56 to seal bearing 244 and the interior of roller 54. Vacuum is thereby drawn through the diamond-shaped vents 240 in roller 54. Roller 54 is rolled over sheet metal 52 after dent 62 is removed by vacuum chamber head 24 to remove any remaining minor surface imperfections. Because roller 54 is round, as it is rolled over a nearly-flat sheet metal surface 52 after dent 62 is removed, the vacuum suction must be continuously overcome. The diamond-shape of vents 240 only requires a small vent surface area (e.g., the tip of the diamond) to be broken initially since the diamond tip rolls up first from sheet metal surface 52. An alternative embodiment of vent 240 shape is illustrated in FIG. 9. Vent 240 has a circular center hole with a pointed "cap" located at the top and bottom of the circular hole. FIG. 10 is a further illustration of one embodiment of shaper vacuum roller 26 in side plan view.

Figure 11:
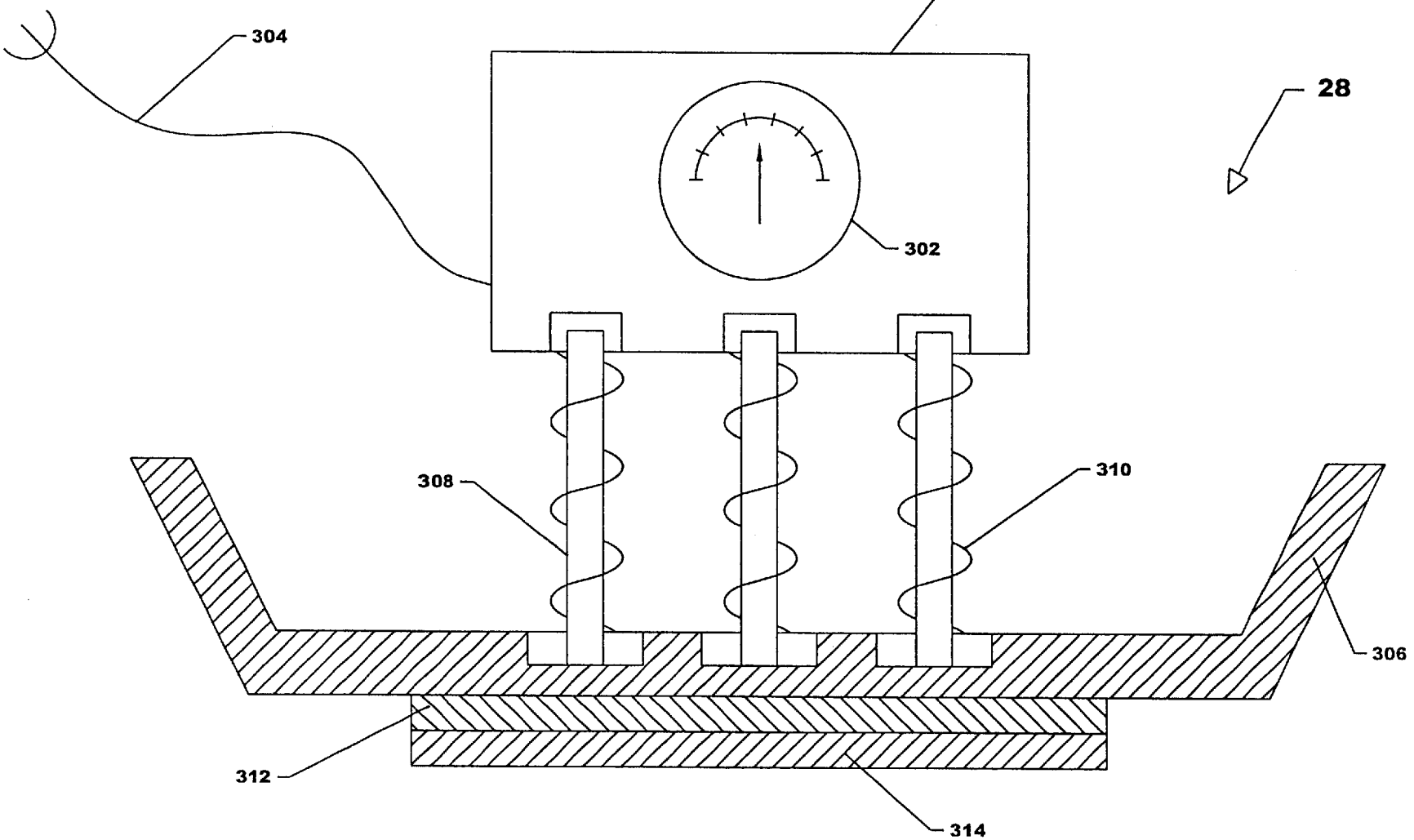
FIG. 11 is a side view of one embodiment of a vibrational energy source.

FIG. 11 is an illustration of one embodiment of vibrational energy source 28. A mass oscillating mechanism 300 is provided with a control 302 to vary the magnitude of oscillation frequency. Mass oscillating mechanism 300 is electrically coupled to an external power supply via cord 304. A tray 306 is recessed to accept a number of standoff legs 308. Mass oscillating mechanism 300 is similarly recessed to accept the other end of standoff legs 308. Standoff springs 310 are interposed between tray 306 and mass oscillating mechanism 300 such that standoff legs do not contact mass oscillating mechanism 300 while at rest. An adhesive layer 312 is interposed between the bottom of try 306 and a magnetic layer 314. During dent removal operations, a thin protective layer, such as wax paper is placed over sheet metal surface 52. Vibrational energy source 28 is placed atop the thin protective layer and magnetic layer 314 acts to adhere to sheet metal surface 52 and communicate the vibrational energy generated by vibrational energy source 28 to dent 62.

A method is provided for removing dents in sheet metal surface 62 using dent removal system 20. Vacuum chamber head 24 is positioned over dent 62 in sheet metal surface 52 and outer base gasket 110 is sealed with downward pressure on casing 100. The sheet metal surface 52 is excited with vibrational energy. Within vacuum chamber head 24, force is applied to moveable plate 152 (surface template) face to hold the template in fixed relation to sheet metal surface 52. The template (moveable plate 152) shape is transmitted to sheet metal surface 52 via the matrix of standoff pins 126. Vacuum is applied to vacuum chamber head 24, through standoff pin 126 matrix to sheet metal surface sucking dent 62 out of sheet metal surface 52 and forcing sheet metal surface 52 into contact with standoff pins 126. Vacuum chamber head 24 is vented to atmosphere, releasing the vacuum, and removed. Shaper vacuum roller 26 is rolled over sheet metal surface to remove minute imperfections. Sanding, grinding, filling, or resurfacing operations are normally not necessary.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A system for forming sheet metal, comprising:

a vacuum chamber head for receiving vacuum into its interior from a vacuum source, having a sealing arrangement for providing a substantially airtight seal between the vacuum chamber head and the sheet metal surface, a template coupled within the interior of the vacuum chamber head, and an outlet valve coupled between the interior and the exterior of the vacuum chamber head; and a vacuum inlet valve coupled between the interior of the vacuum chamber head and the vacuum source, wherein the sealing arrangement includes a plurality of gaskets affixed to the vacuum chamber head such that the plurality of gaskets are situated between the vacuum chamber head and the sheet metal surface, the plurality of gaskets arranged on the vacuum chamber head such that each gasket forms a continuous perimeter, with each successive gasket located within the perimeter of an adjacent gasket, and wherein the vacuum chamber head is adapted to receive vacuum between adjacent gaskets.

2. The system of claim 1, wherein the plurality of gaskets includes an outer gasket, a middle gasket, and an inner gasket, the middle gasket being located between the inner and outer gaskets, and wherein the depth extending away from the vacuum chamber head of the outer gasket is greater than the depth of the middle gasket, and the depth of the middle gasket is greater than the depth of the inner gasket, and wherein the outer gasket has greater compressibility than the middle gasket, and the middle gasket has greater compressibility than the inner gasket such that as the vacuum chamber head receives vacuum and the outer gasket contacts the sheet metal surface to form a seal, the vacuum chamber head and the sheet metal surface are drawn towards each other compressing the outer gasket enough for the middle gasket to contact the sheet metal surface to form a better seal, further compressing the outer gasket and compressing the middle gasket enough for the inner gasket to contact the sheet metal surface to form an even better seal, further compressing all three gaskets.

3. A system for forming sheet metal, comprising:

a vacuum chamber head for receiving vacuum into its interior from a vacuum source, having a sealing arrangement for providing a substantially airtight seal between the vacuum chamber head and the sheet metal surface, a template coupled within the interior of the vacuum chamber head, and an outlet valve coupled between the interior and the exterior of the vacuum chamber head;

a means for indicating the topography of the sheet metal surface and communicating the form of the template to the sheet metal surface while allowing vacuum to pass therethrough; and a vacuum inlet valve coupled between the interior of the vacuum chamber head and the vacuum source.

4. The system of claim 3, further comprising:

a means for dampening movement speed of the sheet metal surface coupled between the sheet metal surface and the vacuum chamber head.

5. The system of claim 3, wherein the means for indicating the topography of the sheet metal surface is visible through a clear window in the vacuum chamber head, the window having crosshairs to indicate the center of the vacuum chamber head and the means for indicating the topography of the sheet metal surface.

6. A system for forming sheet metal, comprising:

a vacuum chamber head for receiving vacuum into its interior from a vacuum source, having a sealing arrangement for providing a substantially airtight seal between the vacuum chamber head and the sheet metal surface, a template coupled within the interior of the vacuum chamber head, and an outlet valve coupled between the interior and the exterior of the vacuum chamber head;

a vibrational energy source coupled to the sheet metal surface in proximity of the vacuum chamber head; and a vacuum inlet valve coupled between the interior of the vacuum chamber head and the vacuum source.

7. The system of claim 6, wherein the vibrational energy source is magnetically coupled to the sheet metal surface through a thin protective layer.

8. A system for forming sheet metal, comprising:

a vacuum chamber head for receiving vacuum into its interior from a vacuum source, having a sealing arrangement for providing a substantially airtight seal between the vacuum chamber head and the sheet metal surface, a template coupled within the interior of the vacuum chamber head, and an outlet valve coupled between the interior and the exterior of the vacuum chamber head;

a vacuum inlet valve coupled between the interior of the vacuum chamber head and the vacuum source;

a shaper vacuum roller to simultaneously apply attractive forces to portions of the sheet metal surface and compressive forces to adjacent portions of the sheet metal surface; and a shaper vacuum roller hose coupled between the vacuum source and the shaper vacuum roller such that the shaper vacuum roller receives vacuum.

9. An apparatus for forming sheet metal, comprising:

a cylinder having a cylindrical wall, a first end, and a second end, defining an internal cavity wherein the first end is adapted to receive a vacuum and the cylindrical wall defines at least one vent therethrough to direct the vacuum through the vent(s), such that when a portion of the cylindrical wall is placed in contact with the sheet metal, the vacuum applies an attractive force, directed toward the cylinder internal cavity, to portions of the sheet metal adjacent the vent(s) and the cylinder wall applies a compressive force, directed substantially opposite the attractive force, to portions of the sheet metal in contact with the cylindrical wall.

10. The apparatus of claim 9, further comprising:

a housing, wherein the cylinder is rotatably coupled, on at least one of the first end or second end of the cylinder, to the housing, and wherein when the portion of the cylindrical wall is placed in contact with the sheet metal, the housing substantially encloses a portion of the cylindrical wall not in contact with the sheet metal such that vacuum directed through the vent(s), defined by the portion of the cylinder wall not in contact with the sheet metal, is impeded.

11. The apparatus of claim 9, wherein the cylinder wall defines a plurality of vents, arranged in a pattern, the vents spaced uniformly about the length and circumference of the cylindrical wall.

12. The apparatus of claim 9, wherein each of the vent(s) occupies an arc defining a portion of the cylinder wall's circumference, the arc having a length and two ends, and wherein the shape of the vent(s) is adapted to be tapered along the length of the arc such that the width of the vent(s), measured parallel to the longitudinal axis of the cylinder, on at least one end of the arc, is less than the width of the vent(s) between the ends of the arc.

13. The apparatus of claim 12, wherein the vent(s) are substantially diamond-shaped.

14. The apparatus of claim 9, further comprising a means to control the receipt of vacuum into the cylinder internal cavity.

15. A method of forming a sheet metal surface using a vacuum, comprising:

positioning a vacuum chamber head having an internal template over the sheet metal surface;

sealing the vacuum chamber head to the sheet metal surface;

exciting the sheet metal surface with vibrational energy prior to supplying vacuum to the vacuum chamber head;

supplying vacuum to the vacuum chamber head to pull the sheet metal surface into the shape of the internal template;

venting the vacuum chamber head to remove the vacuum; and removing the vacuum chamber head.

16. A method of forming a sheet metal surface using a vacuum, comprising:

positioning a vacuum chamber head having an internal template over the sheet metal surface;

sealing the vacuum chamber head to the sheet metal surface;

applying resistive force to the sheet metal surface, prior to supplying vacuum to the vacuum chamber head, such that speed of the sheet metal surface movement induced by vacuum is dampened;

supplying vacuum to the vacuum chamber head to pull the sheet metal surface into the shape of the internal template;

venting the vacuum chamber head to remove the vacuum; and removing the vacuum chamber head.

17. A method of forming a sheet metal surface using a vacuum, comprising:

positioning a vacuum chamber head having an internal template over the sheet metal surface;

sealing the vacuum chamber head to the sheet metal surface;

supplying vacuum to the vacuum chamber head to pull the sheet metal surface into the shape of the internal template;

venting the vacuum chamber head to remove the vacuum;

removing the vacuum chamber head; and rolling the sheet metal surface to a uniform profile with a shaper vacuum roller to simultaneously apply attractive forces to portions of the sheet metal surface and compressive forces to adjacent portions of the sheet metal surface.

18. A method of forming a sheet metal surface using a vacuum, comprising:

a vacuum chamber head for receiving vacuum into its interior from a vacuum source, having a sealing arrangement for providing a substantially airtight seal between the vacuum chamber head and the sheet metal surface, a template coupled within the interior of the vacuum chamber head, and an outlet valve coupled between the interior and the exterior of the vacuum chamber head; and a vacuum inlet valve coupled between the interior of the vacuum chamber head and the vacuum source, wherein the template is slidably coupled within the interior of the vacuum chamber head.

* * * * *